US009524842B2

(12) United States Patent
Sisley et al.

(10) Patent No.: US 9,524,842 B2
(45) Date of Patent: Dec. 20, 2016

(54) MOLDED CASE CIRCUIT BREAKERS WITH A SWITCH PCB OVER AN INTERNAL POCKET AND BEHIND A FRONT COVER

(71) Applicant: Eaton Corporation, Cleveland, OH (US)

(72) Inventors: James Patrick Sisley, Baden, PA (US); James Leo Lagree, Robinson Township, PA (US); Richard Paul Malingowski, McDonald, PA (US); Theodore James Miller, Oakdale, PA (US); David Richard Olenak, Bridgeville, PA (US)

(73) Assignee: Eaton Corporation, Cleveland, OH (US)

( * ) Notice: Subject to any disclaimer, the term of this patent is extended or adjusted under 35 U.S.C. 154(b) by 30 days.

(21) Appl. No.: 14/659,247

(22) Filed: Mar. 16, 2015

(65) Prior Publication Data

US 2016/0181046 A1 Jun. 23, 2016

Related U.S. Application Data

(60) Provisional application No. 62/094,481, filed on Dec. 19, 2014.

(51) Int. Cl.

| | |
|---|---|
| ***H01H 71/10*** | (2006.01) |
| ***H01H 71/02*** | (2006.01) |
| ***H01H 71/04*** | (2006.01) |
| *H01H 71/08* | (2006.01) |

(52) U.S. Cl.

CPC ..... *H01H 71/1045* (2013.01); *H01H 71/025* (2013.01); *H01H 71/0207* (2013.01); *H01H 71/0228* (2013.01); *H01H 71/04* (2013.01); *H01H 2071/086* (2013.01)

(58) Field of Classification Search

CPC H01H 71/0207; H01H 71/04; H01H 71/0228; H01H 71/025; H01H 71/1045; H01H 2071/086

See application file for complete search history.

(56) References Cited

U.S. PATENT DOCUMENTS

| | | | | |
|---|---|---|---|---|
| 3,148,356 | A | 9/1964 | Hedden, Jr. | |
| 4,300,110 | A | 11/1981 | Bayer et al. | |
| 4,503,408 | A | 3/1985 | Mrenna et al. | |
| 4,654,472 | A | 3/1987 | Goldfarb | |
| 4,736,174 | A | 4/1988 | Castonguay et al. | |
| 4,754,247 | A * | 6/1988 | Raymont | H01H 71/0228 200/303 |
| 4,786,885 | A | 11/1988 | Morris et al. | |
| 4,830,620 | A | 5/1989 | Marks et al. | |
| 5,027,091 | A | 6/1991 | Lesslie et al. | |

(Continued)

OTHER PUBLICATIONS

International Search Report and Written Opinion for corresponding PCT Application No. PCT/US2015/063367, date of mailing Mar. 8, 2016, 11 pages.

*Primary Examiner* — Bernard Rojas
(74) *Attorney, Agent, or Firm* — Myers Bigel, P.A.

(57) ABSTRACT

Molded case circuit breakers (MCCBs) have an MCCB body with at least one switch printed circuit board (PCB) holding between 1-4 recessed switches. The switch PCB has a bottom primary surface and an opposing top primary surface and a cover residing over the switch PCB and attached to the MCCB case body so that an outer end portion of the 1-4 switches held by the switch PCB extends through the cover.

17 Claims, 6 Drawing Sheets

(56) References Cited

U.S. PATENT DOCUMENTS

| | | | | |
|---|---|---|---|---|
| 5,117,211 | A | 5/1992 | Morgan et al. | |
| 5,204,798 | A | 4/1993 | Scott | |
| 5,583,741 | A | 12/1996 | Dosmo | |
| 5,607,313 | A | 3/1997 | Nyman | |
| 5,943,216 | A | 8/1999 | Schmidt | |
| 6,052,047 | A | 4/2000 | Malingowski | |
| D442,146 | S | 5/2001 | Greenberg | |
| 6,239,977 | B1 | 5/2001 | Price et al. | |
| 6,366,188 | B1 * | 4/2002 | Hein | H01H 71/0228 335/132 |
| 6,735,855 | B2 | 5/2004 | Akram et al. | |
| D511,502 | S | 11/2005 | Kim | |
| D547,730 | S | 7/2007 | Azzola | |
| 7,365,624 | B2 | 4/2008 | Young et al. | |
| D587,658 | S | 3/2009 | Azzola | |
| D593,506 | S | 6/2009 | Azzola | |
| D611,002 | S | 3/2010 | Azzola | |
| D631,446 | S | 1/2011 | Lanfear | |
| 7,923,650 | B2 * | 4/2011 | Greenberg | H01H 71/465 200/400 |
| 8,222,983 | B2 | 7/2012 | Zhou et al. | |
| D687,387 | S | 8/2013 | Besana | |
| D707,636 | S | 6/2014 | Besana | |
| D713,801 | S | 9/2014 | Johansson | |
| 2002/0158724 | A1 | 10/2002 | Wellner et al. | |
| 2011/0017581 | A1 | 1/2011 | Hardin et al. | |
| 2015/0122626 | A1 | 5/2015 | Cho | |

* cited by examiner

RECESSED SWITCHES

SURFACE MOUNTED SWITCHES

PCB CONNECTION PATH

MOLDED CASE CIRCUIT BREAKERS WITH A SWITCH PCB OVER AN INTERNAL POCKET AND BEHIND A FRONT COVER

RELATED APPLICATIONS

This application claims the benefit of and priority to U.S. Provisional Application Ser. No. 62/094,481, filed Dec. 19, 2014, the contents of which are hereby incorporated by reference as if recited in full herein.

FIELD OF THE INVENTION

The present invention relates to circuit breakers.

BACKGROUND OF THE INVENTION

Circuit breakers are one of a variety of overcurrent protection devices used for circuit protection and isolation. The circuit breaker provides electrical protection whenever an electric abnormality occurs. In a circuit breaker, current enters the system from a power line and passes through a line conductor to a stationary contact fixed on the line conductor, then to a movable contact. The movable contact can be fixedly attached to an arm and the arm can be mounted to a rotor. As long as the stationary and movable contacts are in physical contact, current passes from the stationary contact to the movable contact and out of the circuit breaker to down line electrical devices.

In the event of an overcurrent condition (e.g., a short circuit), extremely high electromagnetic forces can be generated. The electromagnetic forces repel the movable contact away from the stationary contact. Because the movable contact is fixedly attached to a rotating arm, the arm pivots and physically separates the stationary and movable contacts thus tripping the circuit. Upon separation of the contacts and blowing open the circuit, an arcing condition occurs. The breaker's trip unit will trip the breaker which will cause the contacts to separate. Also, arcing occurs during normal "ON/OFF" operations on the breaker. It is desirable to suppress resultant arcs.

A typical method of suppressing the arc is to direct it into an arc chute, which is generally a series of metal plates that dissipate the energy of the arc. This arc chute is situated proximate to the stationary contact point of the circuit.

Conventionally, as shown in FIG. 1, molded case circuit breakers (MCCB's) 10 hold one or more switches 15 on a switch printed circuit board ("PCB") 20 so that the switches extend out of a housing or cover 22. The switch PCB 20 resides in front of (over) an accessory pocket 30 and typically includes an accessory mounting surface 31 that can accommodate customer-selected electronics and/or accessories.

SUMMARY OF EMBODIMENTS OF THE INVENTION

Embodiments of the invention provide recessed switch mounting on the switch PCB to move the switch PCB closer to the cover and thereby provide increased pocket size that can accommodate more or different accessories and/or electronics relative to conventional pockets of MCCBs answering a customer demand and/or long felt need for smaller mechanical footprints able to accommodate increased function inside electronic trip units.

Embodiments of the invention are directed to a molded case circuit breaker (MCCB). The MCCB includes an MCCB body with at least one internal pocket with four sidewalls and a switch printed circuit board (PCB) holding at least one recessed switch. The switch PCB can reside over a top of the at least one internal pocket. The switch PCB has a bottom primary surface and an opposing top primary surface. The MCCB also includes a cover residing over the switch PCB attached to the MCCB case body so that an outer end portion of the at least one switch held by the switch PCB extends at least partially into and/or through the cover.

The cover can have an outer surface that is closely spaced apart from the switch PCB bottom primary surface by a distance $D_1$ that is about 0.157 inches.

The cover can have a perimeter with first and second rectangular panel segments connected by a laterally extending segment can have a height that is less than a height of the first and second rectangular segments. The laterally extending segment can reside under an open window space of the cover bounded by inner perimeter segments of the first and second rectangular panel segments. The breaker handle can extend outward through the window. The switch PCB can reside under the first or second rectangular panel segment.

The cover can have at least one left side and/or right side corner segment that extends inward a distance to define a left and/or right outer wall of a cavity, adjacent an inner front surface of the cover. The switch PCB can reside entirely in the cavity. A headspace can extend under the bottom primary surface of the switch PCB in the cavity of the cover.

The at least one switch can have a plurality of outwardly extending legs that are electrically attached to the bottom primary surface of the switch PCB.

The MCCB can include a planar accessory mounting surface in a lower region of the at least one pocket. A distance to the accessory mounting surface measured from the bottom primary surface of the switch PCB can have a length $D_2$ that is about 1.050 inches.

The MCCB can include an accessory held in at least one of the at least one pocket with a lower surface of the accessory held against an accessory mounting surface in the at least one pocket and an electrical insulator residing between the accessory and the switch PCB.

The accessory can be one of an under voltage release, a shunt, an auxiliary switch or a bell alarm accessory.

The switch PCB can include a first and second switch PCB. The at least one pocket can include first and second pockets residing on opposing sides of a breaker handle. The cover can extend across both the first and second pockets and can have an intermediate window for the breaker handle. The cover can have switch visual indicia about a plurality of switch apertures. The at least one switch can be a plurality of switches held recessed on respective first and second switch PCBs, the first switch PCB held over the first pocket and the second switch PCB held over the second pocket, both residing under and adjacent to the cover. The switches can have an outwardly extending length sufficient to extend through the switch apertures in the cover to position outer ends of the switches outside the cover.

The MCCB can be between a 100V-600 V MCCB and can include a respective 100 V-600 V insulating member residing under the bottom of the switch PCB above one of the at least one pocket.

Other embodiments are directed to a molded case circuit breaker (MCCB) with an MCCB body and at least one switch printed circuit board (PCB) holding between 1-4 recessed switches. The switch PCB has a bottom primary surface and an opposing top primary surface. The MCCB also includes a cover residing over the switch PCB and attached to the MCCB case body so that outer end portions of the 1-4 recessed switches extend outward through the cover. The cover can have an outer surface with switch apertures sized and configured to allow the outer end portions of the recessed switches to extend therethrough. The cover can be closely spaced apart from the switch PCB bottom primary surface by a distance $D_1$ that is about 0.157 inches.

The MCCB body can define first and second spaced apart internal accessory pockets, each having a respective four molded sidewalls, one accessory pocket on each side of a breaker handle. The at least one switch PCB can include first and second switch PCBs. The first switch PCB can be above the first accessory pocket and the second switch PCB can be above the second accessory pocket.

The cover can have left and right corner segments that each step down in an inward direction from a front of the cover to define a respective left side wall of a left side internal cavity and a right side wall of a right side internal cavity, both under a front inner surface of the cover, the right side cavity residing above the first accessory pocket of the MCCB body and the left side cavity residing above the second accessory pocket of the MCCB body. The bottom primary surfaces of respective switch PCBs can reside a distance above a lower inwardly facing end of a corresponding left and right side wall, and wherein the cover comprises respective headspaces in the right and left side cavities of about 0.04 inches measured from the bottom primary surface of a respective switch PCB to a plane drawn across a corresponding lower inwardly facing end of the right and left side walls of the right and left corner segments.

Each of the 1-4 switches can have a plurality of outwardly extending legs that are electrically attached to the bottom primary surface of a respective switch PCB.

The MCCB can include a planar accessory mounting surface in a lower region of the first and second accessory pockets. A distance between the accessory mounting surface and the bottom primary surface of the switch PCB has a length $D_2$ that can be about 1.050 inches.

The MCCB can include an accessory held at least one of the first and second accessory pockets against an accessory mounting surface and an electrical insulator residing between the accessory and the switch PCB.

The accessory can be an under voltage release, a shunt, an auxiliary switch or a bell alarm accessory.

The cover can extend across both the first and second accessory pockets and can have an intermediate window for the breaker handle. The cover can have switch visual indicia about a plurality of switch apertures.

The MCCB can be a 600 V MCCB and can include first and second 600V insulating members residing under the bottom of a respective first and second switch PCB above corresponding first and second pockets.

The MCCB can be an MCCB in a range of 100V 1500 V MCCB and can include first and second appropriately rated insulating members residing under the bottom of a respective first and second switch PCB above corresponding first and second pockets.

The cover can have a perimeter with first and second rectangular panel segments connected by a laterally extending segment having a height that is less than a height of the first and second rectangular segments. The laterally extending segment can reside under an open window space of the cover bounded by inner perimeter segments of the first and second rectangular panel segments and the breaker handle extends outward through the window. The first switch PCB can reside under the first rectangular panel segment and the second switch PCB can reside under the second rectangular panel segment.

Still other embodiments are directed to a molded case circuit breaker (MCCB). The MCCB can include a MCCB body with first and second rectangular internal pockets, a breaker handle residing between the first and second internal pockets, a first switch printed circuit board (PCB) and a second switch printed circuit board. Each PCB holding at least one recessed switch, the first switch PCB residing over the first internal pocket and the second switch PCB residing over the second internal pocket. The switch PCBs have a bottom primary surface and an opposing top primary surface. The MCCB can also include a cover residing over the first and second switch PCBs attached to the MCCB case body so that an outer end portion of the at least one switch held by respective switch PCBs extend at least partially into, typically through the cover. The cover has a perimeter with first and second rectangular panel segments connected by a laterally extending segment having a height that is less than a height of the first and second rectangular segments. The laterally extending segment resides under an open window space of the cover bounded by inner perimeter segments of the first and second rectangular panel segments and the breaker handle extends outward through the window. The first switch PCB resides under the first rectangular panel segment and the second switch PCB resides under the second rectangular panel segment.

Further features, advantages and details of the present invention will be appreciated by those of ordinary skill in the art from a reading of the figures and the detailed description of the preferred embodiments that follow, such description being merely illustrative of the present invention.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DETAILED DESCRIPTION OF EMBODIMENTS OF THE INVENTION

Figure 2:
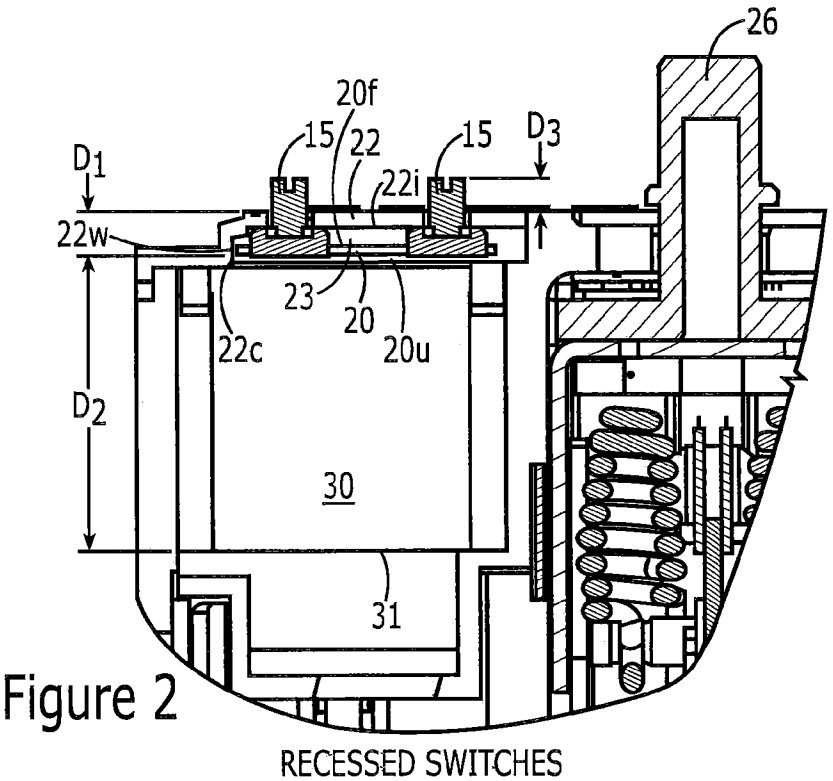
FIG. 2 is a partial section view of a portion of an MCCB with increased headspace and/or pocket size relative to the conventional MCCB shown in FIG. 1 according to embodiments of the present invention.

The present invention now will be described more fully hereinafter with reference to the accompanying drawings, in which illustrative embodiments of the invention are shown. Like numbers refer to like elements and different embodiments of like elements can be designated using a different number of superscript indicator apostrophes (e.g., 40, 40', 40", 40'").

In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art. The term "FIG." (whether in all capital letters or not) is used interchangeably with the word "Figure" as an abbreviation thereof in the specification and drawings.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

The term "about" refers to numbers in a range of +/−20% of the noted value.

As used herein, the singular forms "a," "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

Figure 3B:
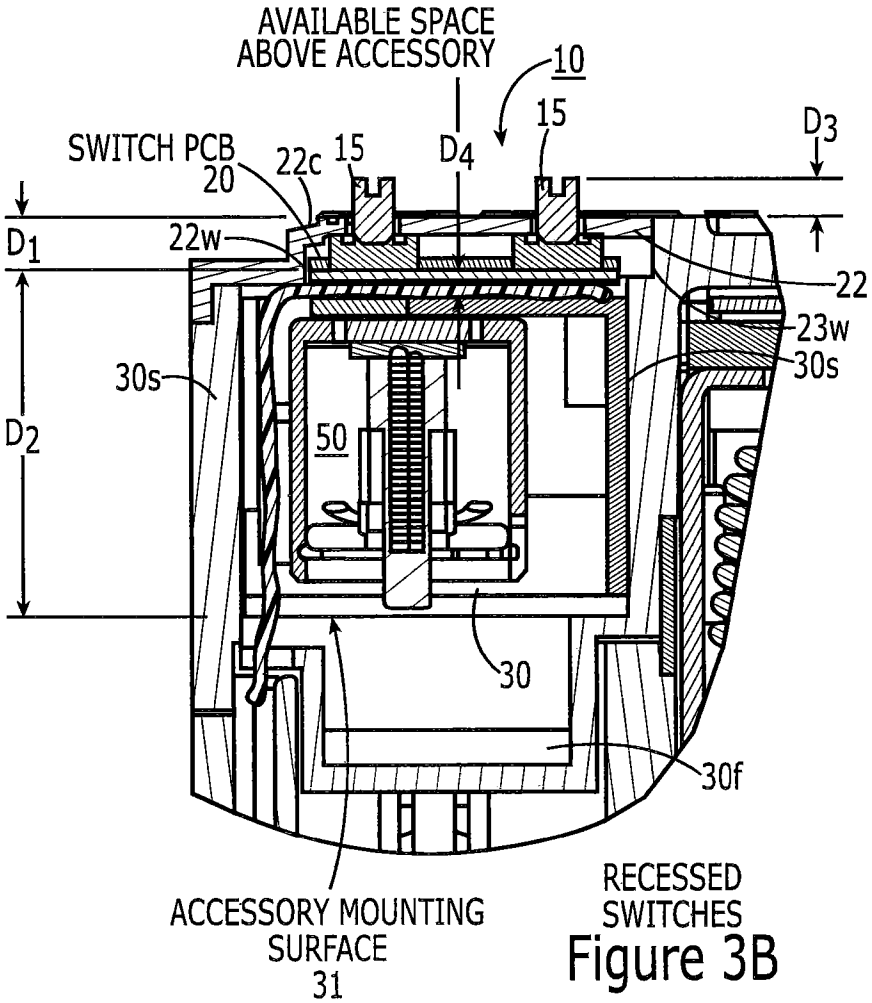
FIG. 3B is a partial section view of the same portion of the MCCB shown in FIG. 3A but illustrating additional space provided by recessed switches on a switch PCB moved closer to the cover according to embodiments of the present invention.
Figure 4:
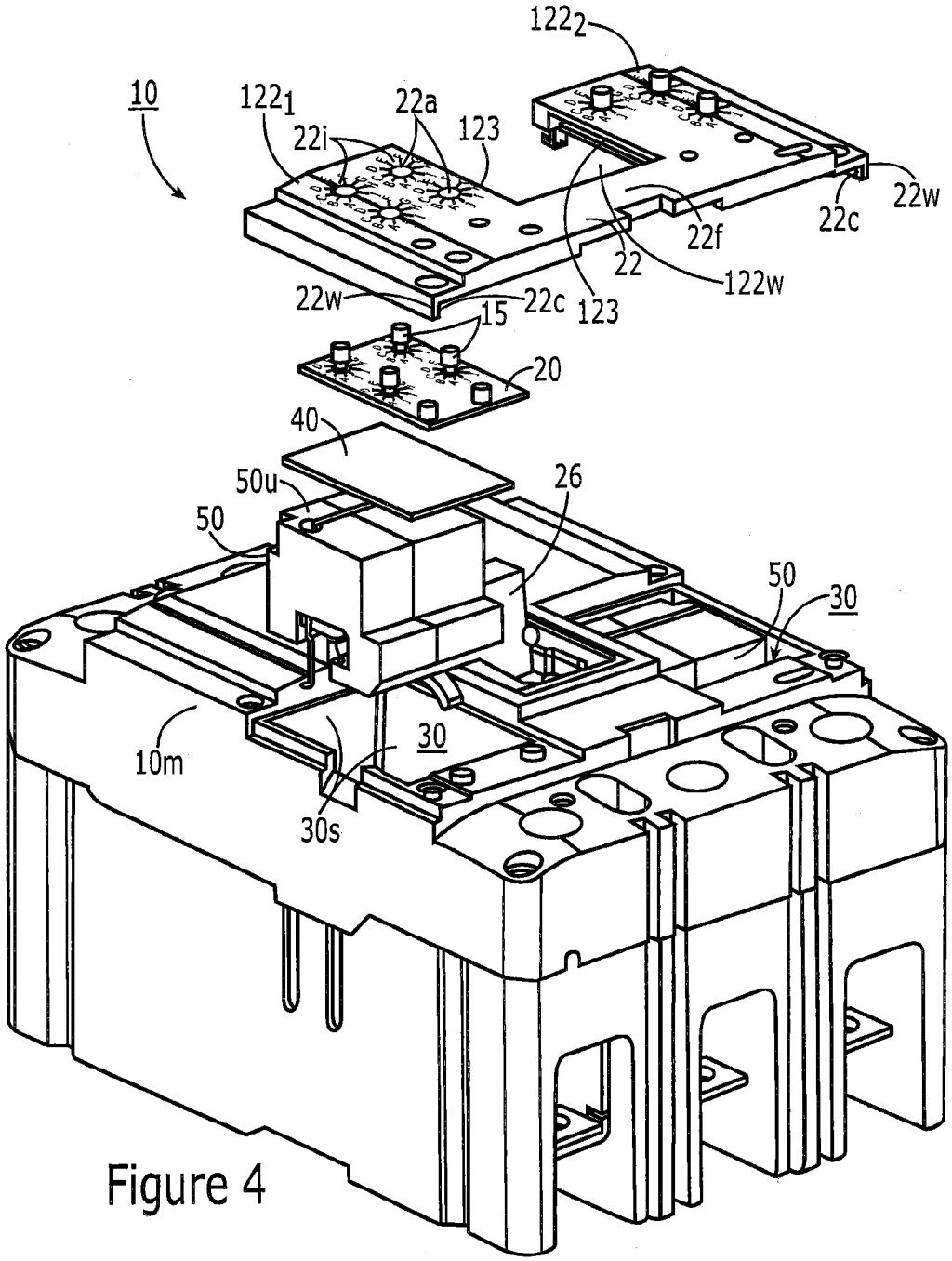
FIG. 4 is a side perspective, partial exploded view of an MCCB according to embodiments of the present invention.

Turning now to the figures, FIG. 2 illustrates an MCCB 10 with the switches 15 held by the switch PCB 20 in a recessed switch mounting configuration to increase the size of the pocket 30. The term "recessed switch" refers to a mounting configuration such that the body of the switch 15 is mounted to be recessed a distance into a thickness of the PCB rather than being flush mounted (e.g., a bottom of the switch residing on and attached to the outer surface of the PCB) on a top or bottom surface thereof. The MCCB 10 typically includes a pocket 30 on each side of the breaker handle 26 as shown in FIG. 4, for example. The pocket 30 can be rectangular with four upwardly extending sidewalls 30*s* that are typically defined by a molded case body 10*m*. The pocket 30 includes an accessory mounting surface 31 that can be planar and typically resides a distance above a floor 30*f* of the pocket (FIG. 3B). The cover 22 resides over the pocket 30 in an operational state. The switches 15 can allow a user to select various operational settings as is well known to those of skill in the art. The switches 15 can extend a distance beyond the outer surface of the cover as shown. In other embodiments, the switches 15 can be substantially flush with the outer surface of the cover 22. Combinations of protruding and flush switches may also be used.

The distance $D_2$ between the underside of the PCB 20*u* and the accessory mounting surface 31 can be increased by decreasing the distance $D_1$ between the inner surface of the secondary cover 22*i* and the front surface of the switch PCB 20*f*. The switch PCB 20 resides closer to the secondary cover 22 and increases the pocket size 30 while the switches 15 themselves can have the same dimensions and remain in the same position relative to the cover 22 and have the same external height/length dimension $D_3$.

The increase in pocket size 30 can be created using the same external mechanical footprint of the MCCB 10. Surprisingly, even the relatively small/modest increase in pocket size can provide beneficial results and allow flexibility and additional choices of accessories. The pocket 30 can accommodate more or different accessories and/or electronics relative to conventional pockets of MCCBs answering a customer demand and/or long felt need for smaller mechanical footprints able to accommodate increased function inside electronic trip units.

Figure 3A:
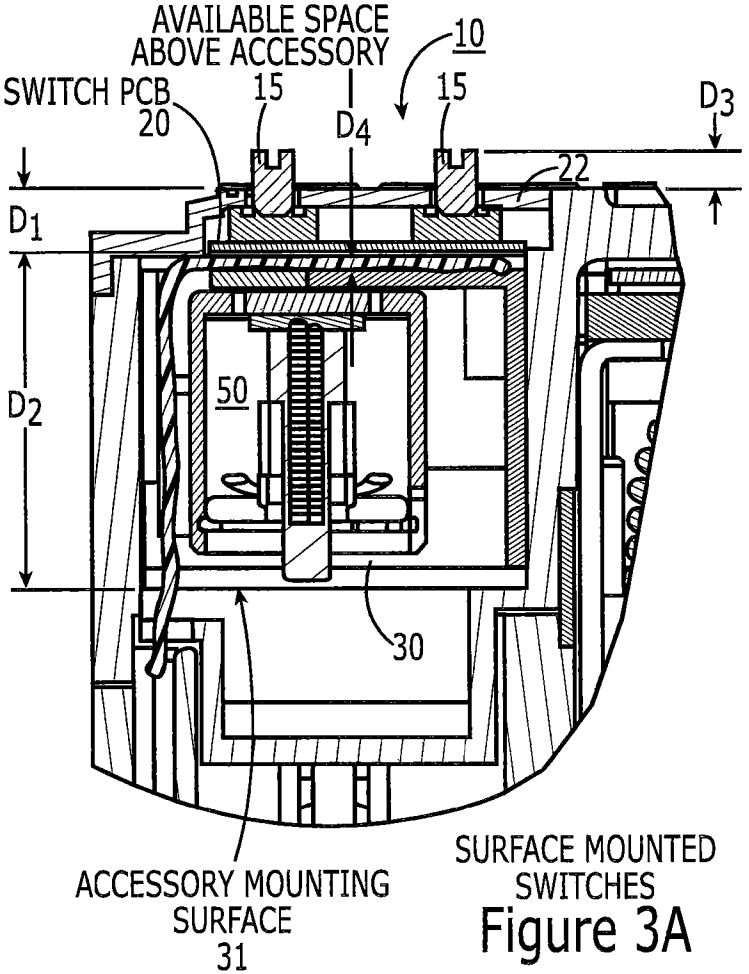
FIG. 3A is a partial section view of a portion of a conventional MCCB holding an accessory in the pocket shown in FIG. 1.

FIGS. 3A and 3B illustrate an exemplary accessory 50, such as an under voltage release ("UVR"), positioned in the pocket 30 against the accessory mounting surface 31. When the recessed switch mounting configuration is used as shown in FIG. 3A, additional headspace with a length $D_4$ can be created above the accessory 50, between the accessory 50 and the underside of the PCB 20*u*. This allows for an additional component 40 to be placed between the upper surface of the accessory 50*u* (FIG. 4) and the bottom of the switch PCB 20*u*. The additional component 40, shown by way of example, is at least one layer or blanket of electrical insulation which can be 600 V rated (for a 600 V circuit breaker) or other suitable voltage rating as discussed below, including but not limited to, in a range of about 100 V-1500 V.

Figure 5:
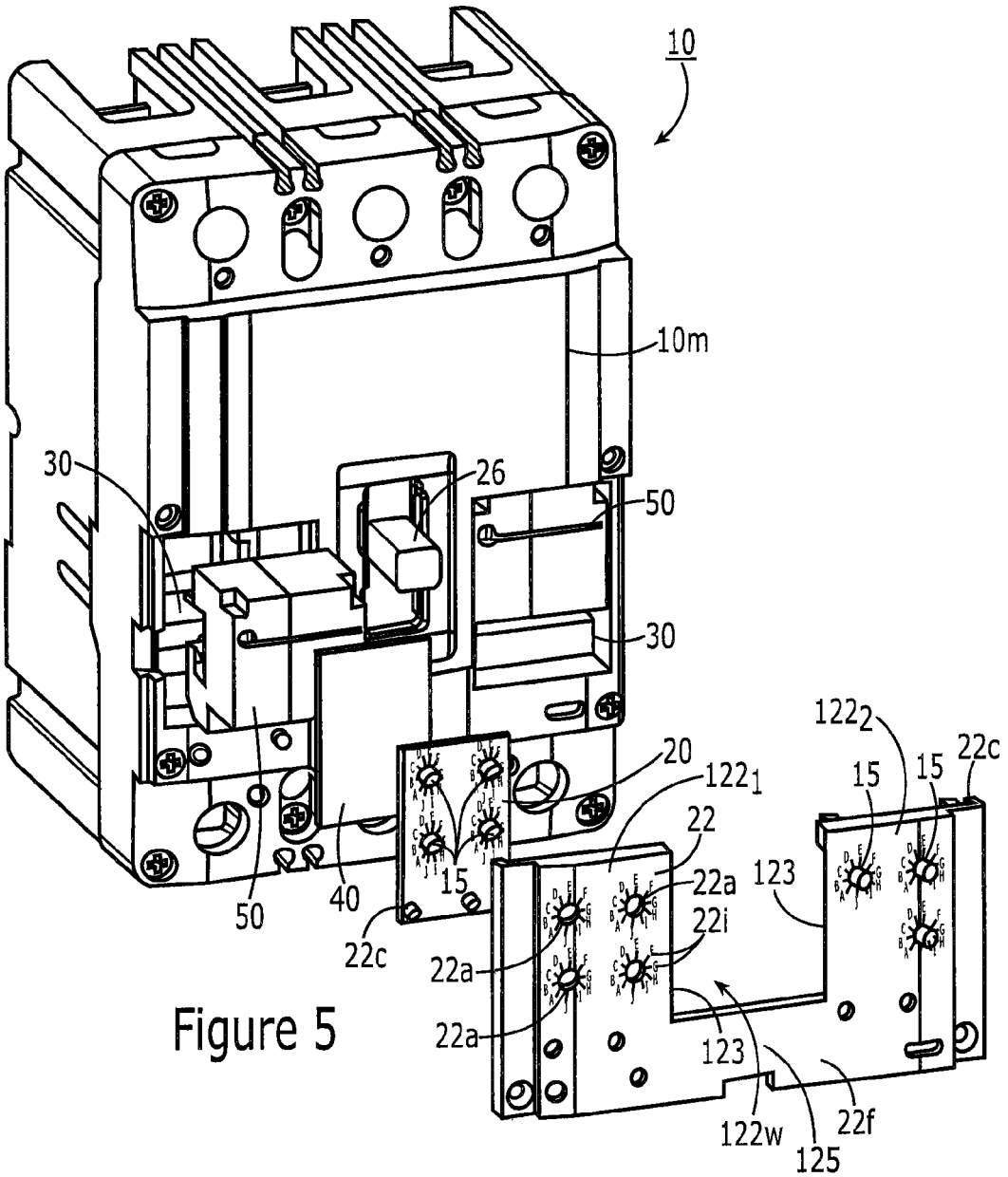
FIG. 5 is a front perspective, partial exploded view of the MCCB shown in FIG. 4 according to embodiments of the present invention.

FIGS. 4 and 5 are partial exploded views of the recessed switches 15 on the switch PCB 20 also illustrating the side-by-side pockets 30, one on each side of the breaker handle 26, according to some embodiments. The cover 22 can include apertures 22*a* for the switches 15 and visual indicia 22*i* about the aperture indicating switch settings. The cover 22 can have a medial window 122*w* that extends about the handle 26.

As shown in FIGS. 4 and 5, for example, the cover 22 can have a perimeter with first and second rectangular panel segments $\mathbf{122}_1$, $\mathbf{122}_2$ connected by a laterally extending segment 125 having a height that is less than a height of the first and second rectangular segments $\mathbf{122}_1$, $\mathbf{122}_2$. The laterally extending segment 125 can reside under an open window space 122*w* of the cover 22 bounded by inner perimeter segments 123 of the first and second rectangular panel segments $\mathbf{122}_1$, $\mathbf{122}_2$. The breaker handle 26 can extend outward through the window 122*w*. The first switch PCB 20 can resides under the first rectangular panel segment $\mathbf{122}_1$ and the second switch PCB 20 can reside under the second rectangular panel segment $\mathbf{122}_2$ (where two switch PCBs are used). The height of the laterally extending segment can be between about 10-40% that of a height of the rectangular segments, more typically in between about 10% to about 30%, inclusive thereof, including about 10%, about 15%, about 20%, about 25% and about 30%. Although not shown, an upper laterally extending segment can be used instead of the lower segment 125 or with the lower laterally extending segment 125, leaving an access window for the breaker handle 26.

Figure 6:
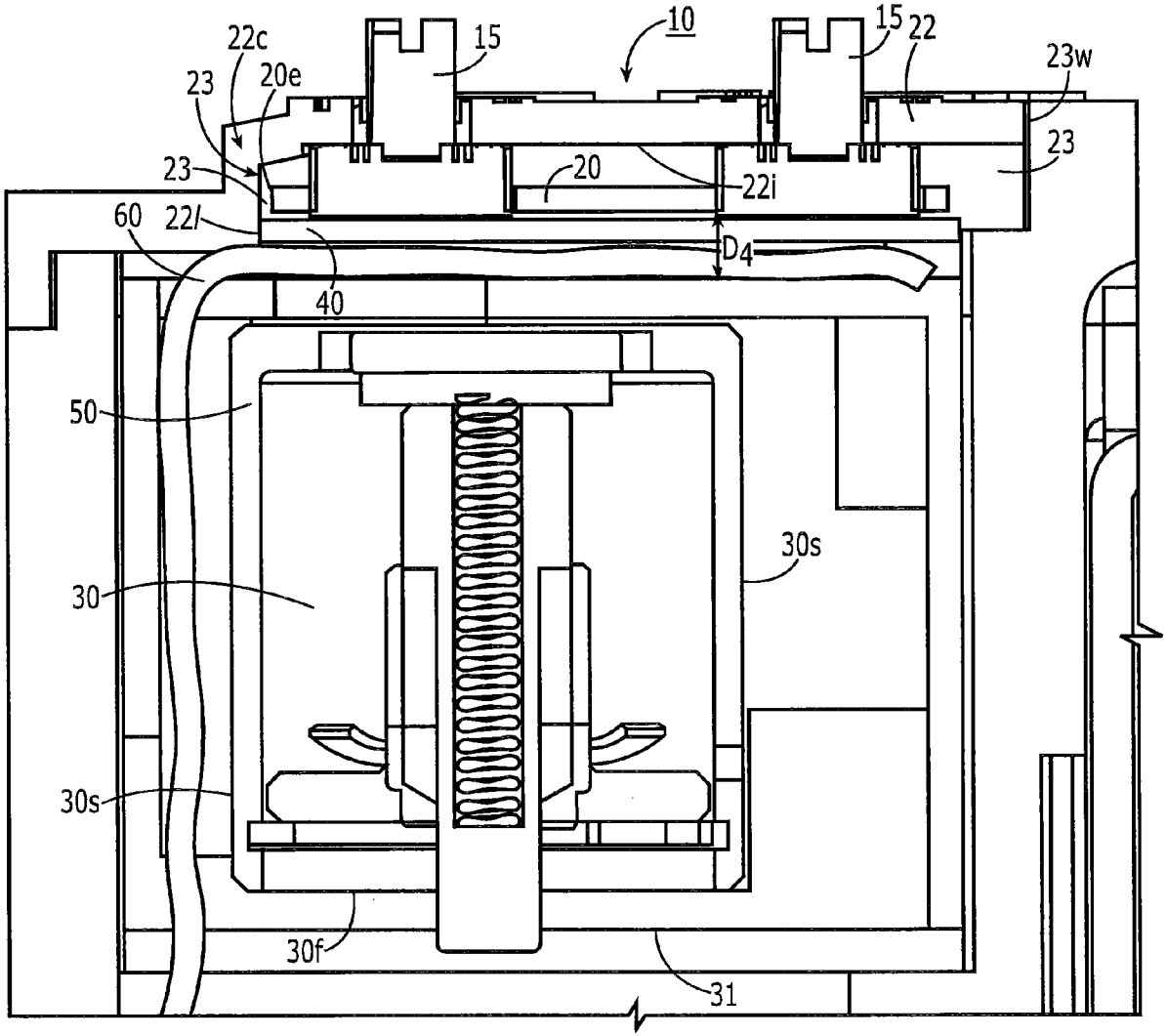
FIG. 6 is a greatly enlarged partial section view of a portion of a MCCB according to embodiments of the present invention.

FIG. 6 is a greatly enlarged section view of a portion of the MCCB 10 with the pocket 30 holding the accessory 50 and with at least one conductor 60 (e.g., lead, cable or wire or groups of leads, cables or wires) positioned between the accessory 50 and the switch PCB 20 according to some embodiments. The at least one conductor 60 can be connected to the accessory 50 and can be routed above and over the accessory down adjacent another sidewall of the pocket 30*s* to provide electrical connection between the accessory 50 and a power source. The headspace under the PCB 20 can accommodate the at least one conductor (e.g., wire) 60 routed between accessory 50 and component 40, e.g., insulation piece. The headspace can hold wires from the accessory 50 occupying that pocket or can include at least one conductor 60 (e.g., a wire or wires) for other purposes, like electronic communication wires that come from other areas or zones of the breaker and run through this headspace to exit the breaker 10 or reach other components.

The switch PCB 20 can electrically connect to a main circuit board and power source.

Figure 1:
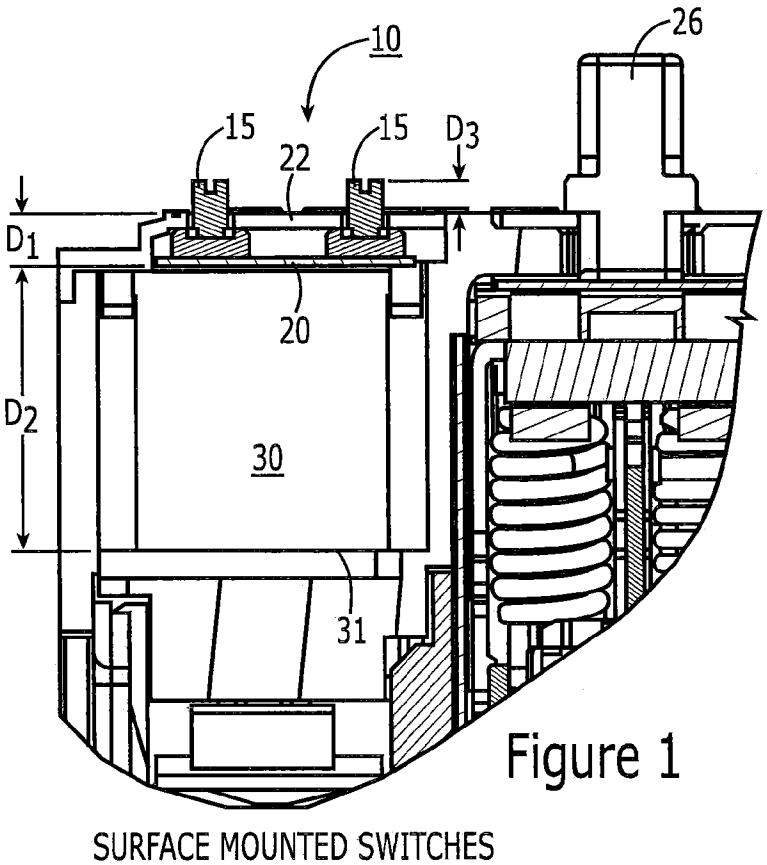
FIG. 1 is a partial section view of a portion of a conventional MCCB.

Referring to FIGS. 1 and 6, the cover 22 can include at least one corner or step segment 22*c* (shown as left corner segment) that extends (down) inwardly to define a wall 22*w* of a cavity 23 residing adjacent an outer perimeter edge 20*e* of the switch PCB 20 over the pocket 30. The cover at the corner segment 22*c* can enclose part of the additional headspace D4 and/or supplemental component 40.

FIGS. 4 and 5 illustrate that the cover 22 can have left and right corner segments 22*c*, that each respectively step down in an inward direction from a front of the cover 22*f* to define a respective outer wall 22*w* of a corresponding first and second internal cavity 23 under a front inner surface of the cover 22*i*. The first cavity 23 can reside above the first (right side) accessory pocket 30 of the MCCB body 10*m* and the second cavity 23 can reside above the second (left side) accessory pocket 30 of the MCCB body 10*m*. The bottom primary surfaces 20*b* of the switch PCBs 20 can reside a distance above an adjacent lowest inwardly facing end 22*l* of the wall 22*w* of the cavity 23.

In some embodiments, the cover 22 with the recessed switches 15 on the switch PCB 20 can provide respective headspaces of about 0.04 inches measured from the bottom primary surface of a respective switch PCB 20 to a plane drawn across a corresponding lower inwardly facing end 22*l* of the right or left wall of the respective corner segments. The cavities 23 can have another opposing inwardly extending wall 23*w* (FIG. 6) under the cover defined by a molded surface of the MCCB body 10*m*. The term "headspace" refers to a space created by the recessed switch mounting on the switch PCB board 20 under the switch PCB.

Figures 7A, 7B:
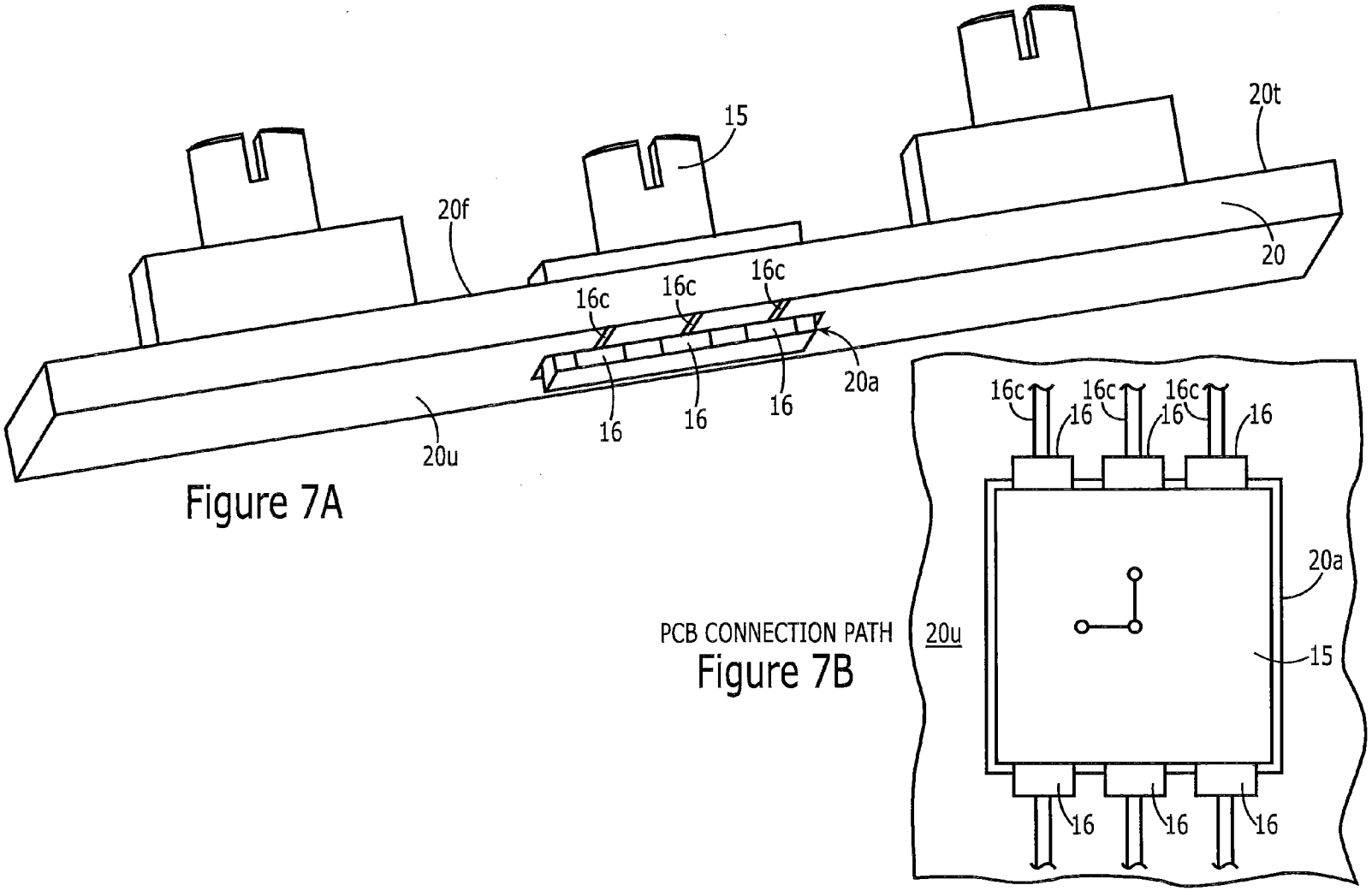
FIG. 7A is a side, bottom perspective view of an exemplary switch PCB illustrating a recessed switch relative to surface mounted switches for visual comparison according to embodiments of the present invention.
FIG. 7B is a bottom view of a portion of the PCB shown in FIG. 7A according to embodiments of the present invention.

As shown by the middle switch in the switch PCB 20 in FIGS. 7A and 7B, the switches 15 can be held recessed in apertures 20*a* formed through the thickness of the switch PCB 20. The switch PCB 20 has upper and lower parallel primary surfaces, one forming the top 20*t* and the other the bottom surface 20*u*. The aperture or apertures 20*a* can be any shape to accommodate the switch body for suitable recessed mounting. The PCB 20 may include slots or channels that allow the recessed mounting rather than circular or rectangular shaped apertures, for example. The one or more switch 15 can have a plurality of electrical contact legs 16 that can be connected 16*c* (typically brazed or soldered) to a bottom side of the PCB 20*u* which can incorporate the electrical paths to the desired electrical connection. The switches 15 on the switch PCB 20 can connect to the main circuit board or other control in the MCCB 10.

The switch PCB 20 can be configured to hold one or a plurality of switches 15 in a recessed configuration, typically between 1-4 switches.

Examples of accessories or electrical components 50 that can be placed in the pocket 30 include different modular shaped assemblies such as the UVR noted above and shunt, auxiliary switches and bell alarm accessories. Examples of additional components that may be placed in the extra headspace $D_4$ above an accessory 50 include different types of wires (accessories and communications) and possibly additional information.

In some exemplary embodiments, the distance $D_1$ (FIGS. 2, 3A) can be about 0.157 inches. In some embodiments, the increase in pocket size can be about 0.04 inches when using recessed versus surface mounted switches 15.

In some embodiments, the circuit breakers 10 can be suitable as AC (alternating current) circuit breakers or both AC and direct current (DC) MCCBs. MCCBs are well known. See, e.g., U.S. Pat. Nos. 4,503,408, 4,736,174, 4,786,885, and 5,117,211, the contents of which are hereby incorporated by reference as if recited in full herein.

In some particular embodiments, the circuit breaker 10 can be a bi-directional DC MCCB. See, e.g., U.S. Pat. No. 8,222,983, the content of which is hereby incorporated by reference as if recited in full herein.

The MCCBs can be suitable for many uses such as data center, photovoltaic, and electric vehicles applications. The circuit breakers 10 can be rated for voltages between about 1 V to about 5000 volts (V), more typically between about 100 V and about 1500 V, inclusive thereof, including about 100 V, about 200 V, about 300 V, about 400 V, about 500 V, about 600 V, about 700 V, about 800 V, about 900 V, about 1000 V, about 1100 V, about 1200 V, about 1300 V, about 1400 V, and about 1500 V. The circuit breakers 10 may have current ratings from about 15 to about 2,500 Amperes (Amp). However, it is contemplated that the circuit breakers 10 and components thereof can be used for any voltage, current ranges and are not limited to any particular application as the circuit breakers can be used for a broad range of different uses.

As is known to those of skill in the art, Eaton Corp. has introduced a line of MCCBs designed for commercial and utility scale photovoltaic (PV) systems. Used in solar combiner and inverter applications, Eaton PVGard™ circuit breakers are rated up to 600 Amp at 1000 Vdc and can meet or exceed industry standards such as UL 489B, which requires rigorous testing to verify circuit protection that meets the specific requirements of PV systems. However, it is contemplated that the circuit breakers 10 can be used for various applications with corresponding voltage capacity/rating.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A molded case circuit breaker (MCCB), comprising:

an MCCB body with at least one internal pocket with four sidewalls;

a switch printed circuit board (PCB) holding at least one recessed switch, the switch PCB residing over a top of the at least one internal pocket, wherein the switch PCB has a bottom primary surface and an opposing top primary surface;

a cover residing over the switch PCB attached to the MCCB case body so that an outer end portion of the at least one switch held by the switch PCB extends to be flush with or extends through the cover, wherein the cover has a perimeter with first and second rectangular panel segments connected by a laterally extending segment having a height that is less than a height of the first and second rectangular segments, wherein the laterally extending segment resides under an open window space of the cover bounded by inner perimeter segments of the first and second rectangular panel segments and the breaker handle extends outward through the window, and wherein the switch PCB resides under the first or second rectangular panel segment; and a planar accessory mounting surface in a lower region of the at least one internal pocket, wherein the cover has at least one left side and/or right side corner segment that extends inward a distance to define a left and/or right outer wall of a cavity, adjacent an inner front surface of the cover, wherein the switch PCB resides entirely in the cavity, wherein a headspace extends under the bottom primary surface of the switch PCB in the cavity of the cover, and wherein a distance to the accessory mounting surface measured from the bottom primary surface of the switch PCB has a length $D_2$ that is about 1.050 inches.

2. The MCCB of claim 1, wherein the cover has an outer surface that is closely spaced apart from the switch PCB bottom primary surface by a distance $D_1$ that is about 0.157 inches.

3. The MCCB of claim 1, wherein the at least one switch has a plurality of outwardly extending legs that are electrically attached to the bottom primary surface of the switch PCB.

4. The MCCB of claim 1, further comprising an accessory held in at least one of the at least one pocket with a lower surface of the accessory held against an accessory mounting surface in the at least one pocket and an electrical insulator residing between the accessory and the switch PCB.

5. The MCCB of claim 4, wherein the accessory is one of an under voltage release, a shunt, an auxiliary switch or a bell alarm accessory.

6. A molded case circuit breaker (MCCB), comprising:

an MCCB body with at least one internal pocket with four sidewalls;

at least one switch printed circuit board (PCB) holding at least one recessed switch, the switch PCB residing over a top of the at least one internal pocket, wherein the switch PCB has a bottom primary surface and an opposing top primary surface; and a cover residing over the switch PCB attached to the MCCB case body so that an outer end portion of the at least one switch held by the switch PCB extends to be flush with or extends through the cover, wherein the at least one switch PCB is a first switch PCB and a second switch PCB, wherein the at least one pocket comprises first and second pockets residing on opposing sides of a breaker handle, wherein the cover extends across both the first and second pockets and has an intermediate window for the breaker handle, wherein the cover has switch visual indicia about a plurality of switch apertures, and wherein the at least one switch is a plurality of switches held recessed on respective first and second switch PCBs, the first switch PCB held over the first pocket and the second switch PCB held over the second pocket, both residing under and adjacent to the cover, the switches having an outwardly extending length sufficient to extend at least partially into or through the switch apertures in the cover to position outer ends of the switches flush with or outside the cover.

7. The MCCB of claim 1, wherein the MCCB is in a range of between 100V-600 V MCCB and comprises a respective 100 V-600 V insulating member residing under the bottom of the switch PCB above one of the at least one pocket.

8. A molded case circuit breaker (MCCB), comprising:

an MCCB body;

at least one switch printed circuit board (PCB) holding between 1-4 recessed switches, wherein the switch PCB has a bottom primary surface and an opposing top primary surface; and a cover residing over the switch PCB and attached to the MCCB case body so that outer end portions of the 1-4 recessed switches extend outward through the cover, wherein the cover has an outer surface with switch apertures sized and configured to allow the outer end portions of the recessed switches to extend at least partially into or totally therethrough that is closely spaced apart from the switch PCB bottom primary surface by a distance $D_1$ that is about 0.157 inches, and wherein the MCCB body defines first and second spaced apart internal accessory pockets, each having a respective four molded sidewalls, one accessory pocket on each side of a breaker handle, and wherein the at least one switch PCB includes first and second switch PCBs, the first switch PCB above the first accessory pocket and the second switch PCB above the second accessory pocket.

9. The MCCB of claim 8, wherein the cover has left and right corner segments that each step down in an inward direction from a front of the cover to define a respective left side wall of a left side internal cavity and a right side wall of a right side internal cavity, both under a front inner surface of the cover, the right side cavity residing above the first accessory pocket of the MCCB body and the left side cavity residing above the second accessory pocket of the MCCB body, and wherein the bottom primary surfaces of respective switch PCBs reside a distance above a lower inwardly facing end of a corresponding left and right side wall, and wherein the cover comprises respective head-spaces in the right and left side cavities of about 0.04 inches measured from the bottom primary surface of a respective switch PCB to a plane drawn across a corresponding lower inwardly facing end of the right and left side walls of the right and left corner segments.

10. The MCCB of claim 9, wherein each of the 1-4 switches have a plurality of outwardly extending legs that are electrically attached to the bottom primary surface of a respective switch PCB.

11. The MCCB of Claim 8, further comprising a planar accessory mounting surface in a lower region of the first and second accessory pockets, wherein a distance between the accessory mounting surface and the bottom primary surface of the switch PCB has a length $D_2$ that is about 1.050 inches.

12. The MCCB of Claim 8, further comprising an accessory held at least one of the first and second accessory pockets against an accessory mounting surface and an electrical insulator residing between the accessory and the switch PCB.

13. The MCCB of claim 12, wherein the accessory is an under voltage release, a shunt, an auxiliary switch or a bell alarm accessory.

14. The MCCB of claim 8, wherein the cover extends across both the first and second accessory pockets and has an intermediate window for the breaker handle, wherein the cover has switch visual indicia about a plurality of switch apertures.

15. The MCCB of claim 8, wherein the MCCB is an MCCB in a range of 100 V 1500 V MCCB and comprises first and second appropriately rated insulating members residing under the bottom of a respective first and second switch PCB above corresponding first and second pockets.

16. The MCCB of claim 14, wherein the cover has a perimeter with first and second rectangular panel segments connected by a laterally extending segment having a height that is less than a height of the first and second rectangular segments, wherein the laterally extending segment resides under an open window space of the cover bounded by inner perimeter segments of the first and second rectangular panel segments and the breaker handle extends outward through the window, and wherein the first switch PCB resides under the first rectangular panel segment and the second switch PCB resides under the second rectangular panel segment.

17. A molded case circuit breaker (MCCB), comprising:

an MCCB body with first and second rectangular internal pockets;

a breaker handle residing between the first and second internal pockets;

a first switch printed circuit board (PCB) and a second switch printed circuit board, each holding at least one recessed switch, the first switch PCB residing over the first internal pocket and the second switch PCB residing over the second internal pocket, wherein the switch PCBs have a bottom primary surface and an opposing top primary surface; and a cover residing over the first and second switch PCBs attached to the MCCB case body so that an outer end portion of the at least one switch held by respective switch PCBs extend into and/or through the cover, wherein the cover has a perimeter with first and second rectangular panel segments connected by a laterally extending segment having a height that is less than a height of the first and second rectangular segments, wherein the cover includes an open window space bounded by inner perimeter segments of the first and second rectangular panel segments and the breaker handle extends outward through the window, and wherein the first switch PCB resides under the first rectangular panel segment and the second switch PCB resides under the second rectangular panel segment.

* * * * *